US005309833A

United States Patent [19]

Guaraldi

[11] Patent Number: 5,309,833

[45] Date of Patent: May 10, 1994

[54] PRINTING UNIT WITH VIBRATOR MECHANISM

[75] Inventor: Glenn A. Guaraldi, Kingston, N.H.

[73] Assignee: Heidelberg Druckmaschinen AG, Heidelberg, Fed. Rep. of Germany

[21] Appl. No.: 27,286

[22] Filed: Mar. 4, 1993

[51] Int. Cl.[5] ..... B41F 5/22; B41F 31/14

[52] U.S. Cl. ..... 101/217; 101/220; 101/DIG. 38

[58] Field of Search ..... 101/DIG. 38, 349, 350, 101/177, 178, 179, 180, 181, 217, 219, 220, 142, 143, 221

[56] References Cited

U.S. PATENT DOCUMENTS 2,115,734 5/1938 Lamatsch ..... 101/DIG. 38

*Primary Examiner*—J. Reed Fisher

*Attorney, Agent, or Firm*—Tarolli, Sundheim & Covell

[57] ABSTRACT

A printing apparatus (10) comprises a plurality of ink distributor rolls (20) supported for rotation about their axes (48, 50, 52), a rotatable shaft (90), and a vibrating means (32) for reciprocating the rolls (20) axially in response to rotation of the shaft (90). The vibrating means (32) comprises a plurality of eccentric members (116) fixed to the shaft (90) for rotation with the shaft (90). Each of the eccentric members (116) applies an individual torque to the shaft (90) in response to axial movement of a respective one of the rolls (20) when the eccentric member (116) rotates with the shaft (90). The fixed positions of the eccentric members (116) relative to each other on the shaft (90) minimize the sum of the individual torques and the fluctuations in the sum of the individual torques during rotation of the eccentric members (116). The detrimental effects of the torques on the printed image are thereby minimized.

2 Claims, 6 Drawing Sheets

PRINTING UNIT WITH VIBRATOR MECHANISM

FIELD OF THE INVENTION

The present invention relates to a printing unit for a printing press, and particularly relates to a printing unit having vibrating ink distributor rolls.

BACKGROUND OF THE INVENTION

U.S. Pat. No. 3,994,222 discloses a printing unit having ink distributor rolls which rotate to distribute ink in the printing unit. The printing unit disclosed in the '222 patent also has a vibrator mechanism for vibrating the ink distributor rolls by moving them back and forth along their axes. The vibrating movements of the ink distributor rolls assist in evenly distributing the film of ink on the rolls. The vibrator mechanism includes a rotating shaft and a plurality of eccentrics which are mounted on the shaft to rotate with the shaft. The rotating eccentrics operate a lever mechanism which moves the ink distributor rolls back and forth along their axes. Axial movement of the ink distributor rolls is resisted by the inertia of the ink distributor rolls, and by the friction between the ink distributor rolls and the other rolls which they slide against when moving axially. Such resistance is transmitted by the rotating eccentrics to the rotating shaft in the form of torques which resist rotation of the shaft. Because the shaft is rotated by the same gear train that rotates the printing cylinders in the printing press, the torques applied to the shaft by the eccentrics can be transmitted through the gear train to the rotating printing cylinders. Such transmitted torques can mar the printed image.

SUMMARY OF THE INVENTION

In accordance with the present invention, a printing apparatus comprises a plurality of ink distributor rolls supported for rotation about their axes, a rotatable shaft, and vibrating means for reciprocating the rolls axially in response to rotation of the shaft. The vibrating means comprises a plurality of eccentric members fixed to the shaft for rotation with the shaft. Each one of the eccentric members moves a respective one of the ink distributor rolls axially when it rotates with the shaft. Each one of the rotating eccentric members applies an individual torque to the shaft when it moves the respective ink distributor roll axially. The sum of the individual torques changes as the circumferential positions of the eccentric members and the axial positions of the ink distributor rolls change. The eccentric members are fixed to the shaft in positions which are circumferentially offset from each other about the axis of the shaft. The offset positions of the eccentric members minimize the sum of the individual torques, as well as the magnitude of the changes in the sum of the individual torques, during rotation of the eccentric members.

A printing apparatus constructed in accordance with the present invention vibrates the ink distributor rolls with a minimum amount of interference with the printed image. Each one of the rotating eccentric members moves its respective ink distributor roll axially back and forth as it rotates with the shaft. The axial position of the roll changes as the circumferential position of the rotating eccentric member changes. Because the rotating eccentric member is connected to the roll, it applies a torque to the shaft as it moves the roll back and forth. The magnitude of the torque changes as the circumferential position of the rotating eccentric member changes. Each one of the rotating eccentric members applies an individual torque which contributes to a total torque. The total torque similarly changes in magnitude as all of the individual torques change in magnitude. The total torque can be transmitted through the gear train to the rotating printing cylinders and can mar the printed image. However, the total torque and the changes in magnitude in the total torque are minimized in accordance with present invention. The total torque therefore remains at a relatively low level and does not fluctuate greatly. The low, steady torque causes less interference with the smooth rotation of the printing cylinders as compared with a higher, more greatly fluctuating torque which can impact and jar the printing cylinders.

BRIEF DESCRIPTION OF THE DRAWINGS

The foregoing and other features of the present invention will become apparent to those skilled in the art to which the present invention relates from reading the following specification with reference to the accompanying drawings, in which.

DESCRIPTION OF PREFERRED EMBODIMENT

Figure 1:
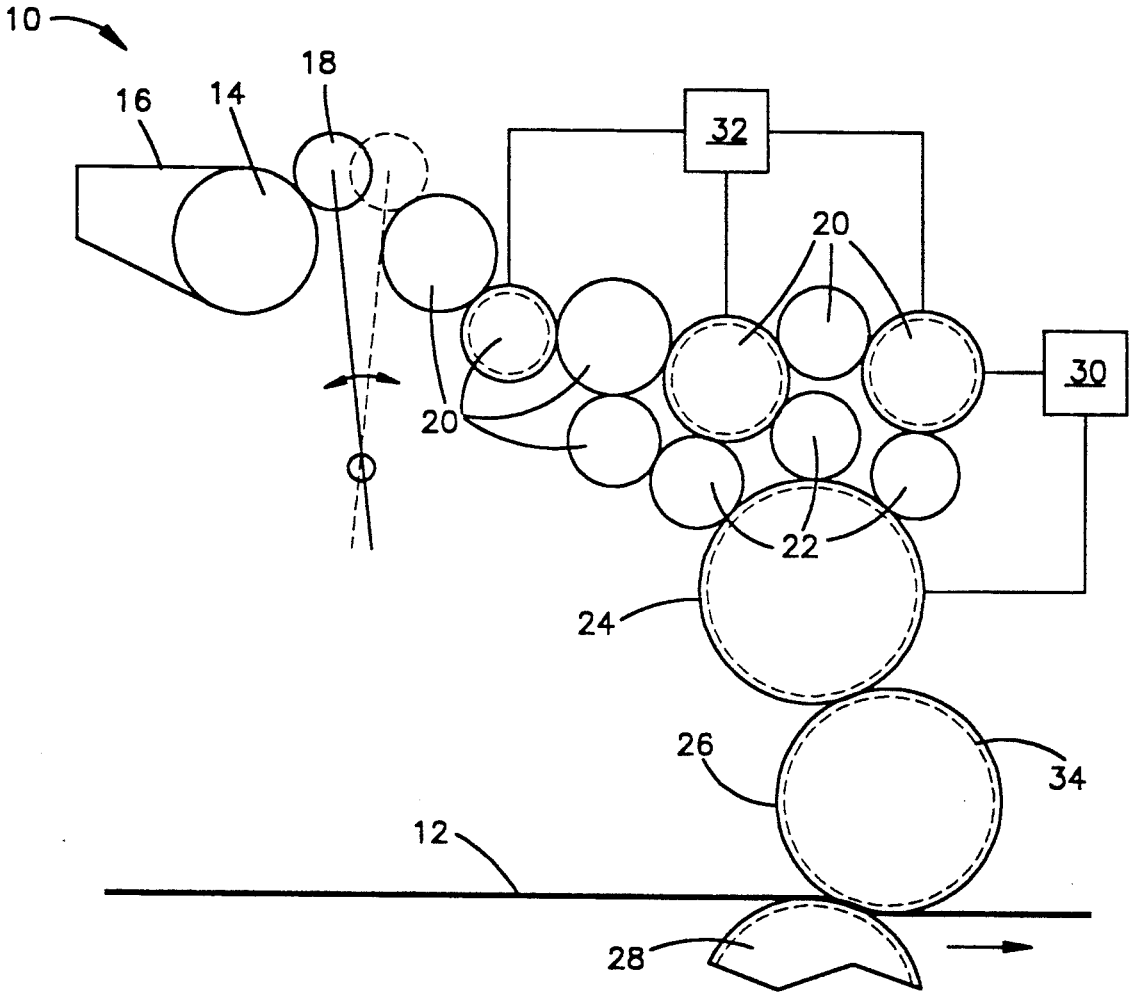
FIG. 1 is a schematic view of a printing unit which comprises a first embodiment of the present invention.

As shown schematically in FIG. 1, a printing unit 10 includes a plurality of rolls and cylinders for printing on a moving web 12. A fountain roll 14 picks up ink from an ink fountain 16. A ductor roll 18 moves back and forth between the fountain roll 14 and a first ink distributor roll 20 to transfer ink from the fountain roll 14 to the first ink distributor roll 20. Additional ink distributor rolls 20 move the ink to a plurality of form rolls 22 which apply the ink to a printing plate on a plate cylinder 24. A blanket cylinder 26 transfers the inked image from the printing plate on the plate cylinder 24 to the web 12 as the web 12 moves through the nip between the blanket cylinder 26 and an impression cylinder 28. The impression cylinder 28 can be another blanket cylinder for printing on the other side of the web 12.

The printing apparatus 10 further includes a drive means 30 and a vibrator mechanism 32. The drive means 30 drives a gear train 34, which is shown schematically in FIG. 1 by dashed lines. The gear train 34 rotates the plate cylinder 24, the blanket cylinder 26, the impression cylinder 28, and several of the ink distributor rolls 20. The vibrator mechanism 32 vibrates those ink distributor rolls by moving them back and forth axially. The axial movements of those ink distributor rolls assist in evenly distributing the film of ink transferred to the form rolls 22.

Figure 2:
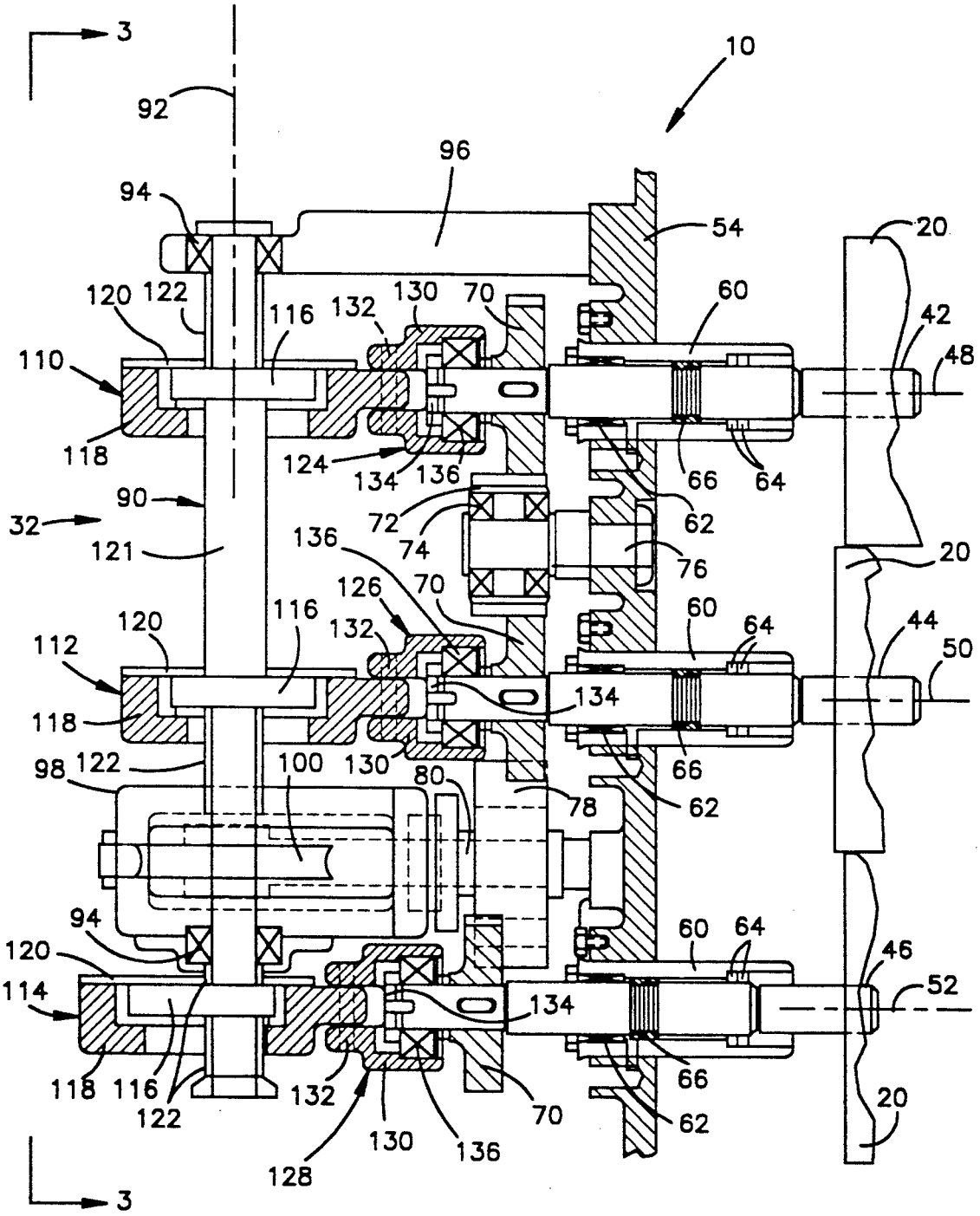
FIG. 2 is a plan view of a portion of the printing unit of FIG. 1.

As shown in detail in FIG. 2, the printing unit 10 comprises three stub shafts 42, 44 and 46 having axes 48, 50 and 52, respectively. The stub shafts 42, 44 and 46 are supported for rotation about their axes in a side frame 54 of the printing unit 10, and are connected to respective ones of the ink distributor rolls 20 (shown schematically) which rotate with the stub shafts 42, 44 and 46 in the printing unit 10. The vibrator mechanism 32 vibrates those ink distributor rolls 20 by moving the stub shafts 42, 44 and 46 back and forth along their axes while the stub shafts 42, 44 and 46 are rotating about their axes.

The stub shafts 42, 44 and 46 extend through the side frame 54 in sleeves 60. The stub shafts 42, 44 and 46 are movable axially in the sleeves 60, and are supported for rotation in the sleeves 60 by roller bearings 62. Gaskets 64 and seals 66 seal the sleeves 60 against the flow of ink from the ink distributor rolls 20.

Three drive gears 70 are keyed to the three stub shafts 42, 44 and 46 to rotate the three stub shafts 42, 44 and 46. A first bridging gear 72 meshes with the first drive gear 70 at the first stub shaft 42, and also meshes with the second drive gear 70 at the second stub shaft 44. The first bridging gear 72 is supported by a roller bearing 74 to rotate freely about a shaft 76 which is fixed to the side frame 54. The first bridging gear 72 thus enables the first drive gear 70 at the first stub shaft 42 to be driven by the second drive gear 70 at the second stub shaft 44.

A second bridging gear 78 meshes with both the second drive gear 70 at the second stub shaft 44 and the third drive gear 70 at the third stub shaft 46. The second bridging gear 78 is also keyed to a rotatable shaft 80. The second bridging gear 78 thus drives the second and third drive gears 70, and also rotates the rotatable shaft 80.

Figure 3:
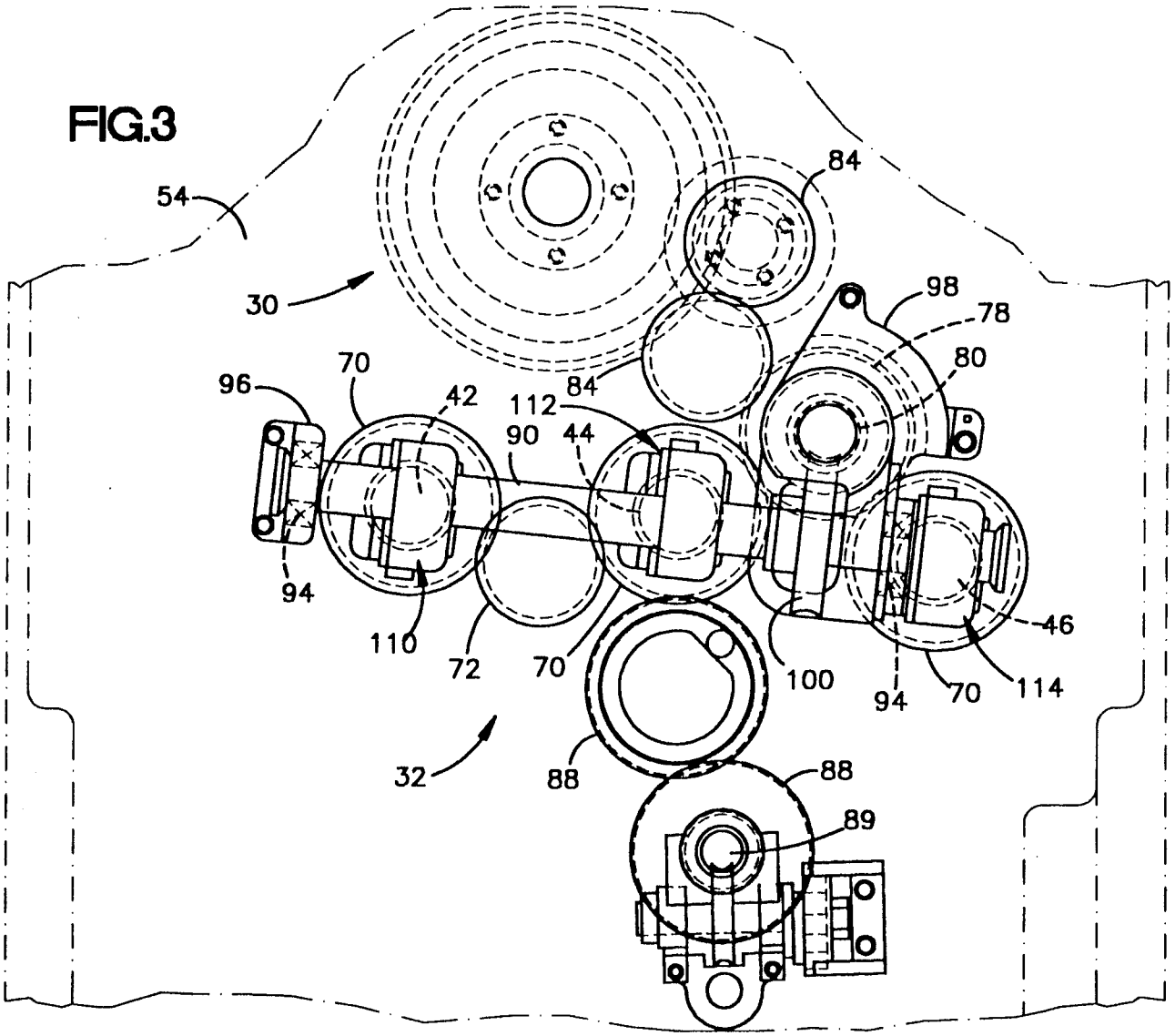
FIG. 3 is a view taken on line 3—3 of FIG. 2.
Figure 4:
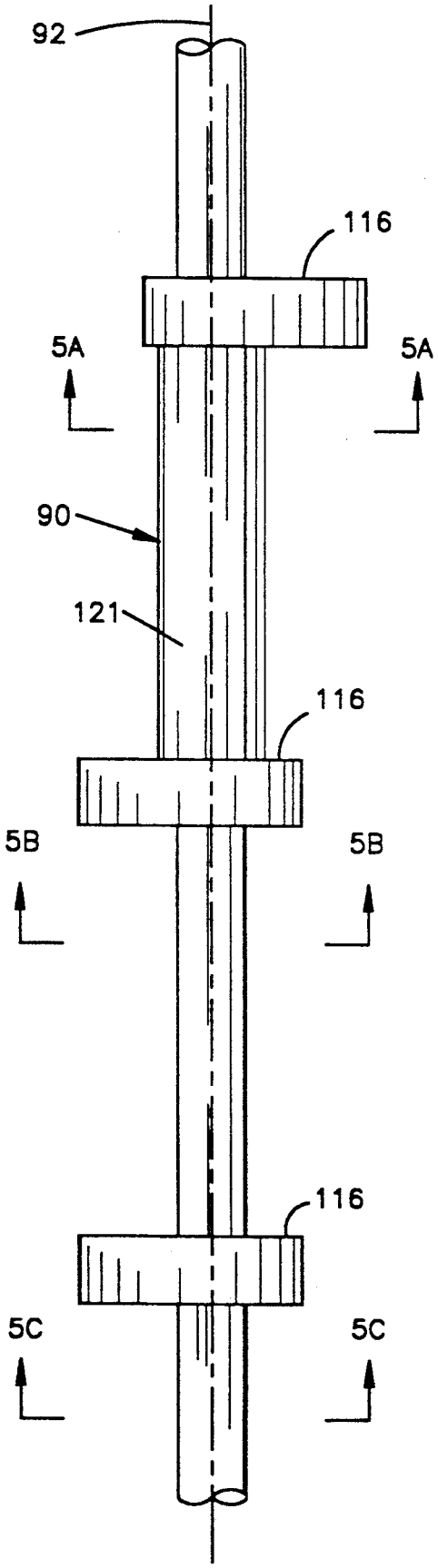
FIG. 4 is a plan view of part of the printing unit of FIG. 1.

As shown in FIG. 3, the drive means 30 rotates the second bridging gear 78 through a pair of drive gears 84. Also shown in FIG. 3 is a pair of drive gears 88 for rotating a dampening solution roll having a stub shaft 89. The drive gears 88 rotate the dampening solution roll in response to rotation of the second drive gear 70 at the second stub shaft 44.

Referring again to FIG. 2, the vibrator mechanism 32 comprises a shaft 90 having an axis 92 perpendicular to the axes 48, 50 and 52 of the stub shafts 42, 44 and 46. The shaft 90 is supported for rotation about the axis 92 by bearings 94 located at the opposite ends of the shaft 90. One of the bearings 94 is supported in an arm 96, which is bolted to the side frame 54 as shown in FIG. 3. The other bearing 94 is contained in a housing 98 which is similarly bolted to the side frame 54. Also contained in the housing 98 is a worm gear 100 which is keyed to the shaft 90, and which meshes with a worm on the shaft 80. The shaft 90 is thus connected to the second bridging gear 78 to be rotated by the second bridging gear 78 through the shaft 80 and the worm gear 100. Moreover, the shaft 90 and the three stub shafts 42, 44 and 46 are all connected to the drive means 30 through the second bridging gear 78 to be rotated simultaneously by the drive means 30.

The vibrator mechanism 32 also includes three eccentric devices 110, 112 and 114 supported on the shaft 90. Each of the three eccentric devices 110, 112 and 114 comprises an eccentric member 116, a housing 118 and a cover plate 120. The first and second eccentric members 116 are located axially on the shaft 90 between an enlarged portion 121 of the shaft 90 and the ends of sleeves 122 which are received over the shaft 90. The third eccentric member 116 is located axially on the shaft 90 between two of the sleeves 122. The three eccentric members 116 are all fixed to the shaft 90, and rotate inside the housings 118 in sliding contact with the housings 118 upon rotation of the shaft 90.

As shown in FIGS. 4 and 5A–5C, the three eccentric members 116 are fixed to the shaft 90 in positions circumferentially offset from each other. Specifically, the center 123 of each eccentric member 116 is offset circumferentially from the center 123 of each other eccentric member 116 by 120° about the axis 92 of the shaft 90.

The vibrator mechanism 32 further includes three connecting devices 124, 126 and 128, as shown in FIG. 2. The first connecting device 124 connects the first eccentric device 110 to the first stub shaft 42. The second connecting device 126 connects the second eccentric device 112 to the second stub shaft 44, and the third connecting device 128 connects the third eccentric device 114 to the third stub shaft 46. Each of the three connecting devices 124, 126 and 128 includes a bracket 130 which is pivotally connected to the associated eccentric housing 118 by a pin 132. Each bracket 130 is axially fixed to the associated stub shaft 42, 44 or 46 by an axial fastener 134, and has a roller bearing 136 for rotation of the associated stub shaft 42, 44 or 46 in the bracket 130.

During operation of the printing unit 10, the stub shafts 42, 44 and 46 are rotated by the drive means 30 through the gear train 34 which includes the various gears described above. Rotation of the stub shafts 42, 44 and 46 causes rotation of the associated ink distributor rolls 20 so that ink is moved through the printing unit 10 by the ink distributor rolls 20.

The shaft 90 in the vibrator mechanism 32 is rotated simultaneously with the rotating stub shafts 42, 44 and 46, also as described above. When the shaft 90 rotates, the eccentric members 116 rotate in sliding contact with the eccentric housings 118, and thereby cause reciprocating movement of the eccentric housings 118 in directions parallel to the axes 48, 50 and 52 of the stub shafts 42, 44 and 46. Because the stub shafts 42, 44 and 46 are axially linked to the eccentric housings 118 by the connecting brackets 130, the reciprocating movements of the eccentric housings 118 are imparted to the brackets 130 and the stub shafts 42, 44 and 46. As shown in FIG. 1, the gear teeth on the first and second bridging gears 72 and 78 are wide enough to remain engaged with the gear teeth on the associated drive gears 70 during axial movement of the drive gears 70 with the stub shafts 42, 44 and 46. The vibrator mechanism 32 thus causes the stub shafts 42, 44 and 46 to reciprocate axially when they are being rotated by the drive means 30. The reciprocating movements of the stub shafts 42, 44 and 46 are vibration-like movements which assist in the distribution of ink by the rotating ink distributor rolls 20.

When the rotating eccentric members 116 are moving the stub shafts 42, 44 and 46 and ink distributor rolls 20 back and forth axially, the rotating eccentric members 116 and the shaft 90 apply forces back and forth against the side frame 54 through the arm 96 and the housing 98. Such forces tend to vibrate the side frame 54. The rotating eccentric members 116 also apply torques to the rotating shaft 90. The torques result from the inertia of the vibrating ink distributor rolls 20, and from the friction between the vibrating ink distributor rolls 20 and the other rolls in the printing unit 10 which they slide against when moving axially. Such torques in the rotating shaft 90 can be transmitted through the various gears to the drive means 30 and to the printing cylinders 24 and 26 which are rotated by the drive means 30. Such torques can interfere with the smooth rotation of the printing cylinders 24 and 26, and can thereby mar the image printed on the web 12.

The vibrator mechanism 32 constructed in accordance with the present invention minimizes the detrimental effects of the rotating eccentric members 116. An individual torque applied to the shaft 90 by an individual rotating eccentric member 116 changes as the rotating eccentric member 116 changes the axial position of the associated ink distributor roll 20. The individual torque at any one time is thus related to the circumferential position of the individual eccentric member 116 at that time. Therefore, the individual torque can be represented graphically by a rectified sine wave. The individual torque reaches a maximum level when the rotating eccentric member 116 has moved its associated ink distributor roll 20 to the end of its path of movement in one axial direction, and reverses the ink distributor roll 20 to move it back in the opposite axial direction. A rectified sine wave representing the individual torque will therefore reach a peak level when the rotating eccentric member 116 is in a position to reverse the axial direction of the associated ink distributor roll 20.

The total torque in the shaft 90 resulting from rotation of the three eccentric members 116 is equal to the sum of the three individual torques applied to the shaft 90 by the three eccentric members 116. The total torque at any one time is thus related to the circumferential positions of the three rotating eccentric members 116 at that time. As described above with reference to FIGS. 4 and 5A–5C, the three eccentric members 116 are fixed to the shaft 90 in positions which are circumferentially offset from each other by 120° about the axis 92. Because the three individual torques are related to the circumferential positions of the three individual rotating eccentric members 116, individual rectified sine waves representing the three individual torques Will be out of phase by 120°. The axial movements of the three vibrating ink distributor rolls 20 are likewise out of phase by 120°. The individual torques therefore reach peak levels at different times 20 which are evenly spaced apart during a 360° rotation of the shaft 90. As a result, the sum of the individual torques at any one time does not differ substantially from the sum at any other time. Changes in the sum of the individual torques are thus minimized in magnitude. The total torque on the rotating shaft 90 therefore remains at a substantially steady level which does not fluctuate greatly during operation of the printing unit 10. Forces transmitted from the rotating shaft 90 to the printing cylinders 24 and 26 in the printing unit 10 likewise remain at a substantially steady level. Such steady forces will not mar the printed image as severely as fluctuating forces which impact and jar the cylinders 24 and 26.

Figure 5A:
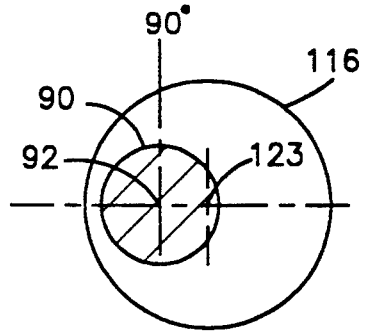
FIGS. 5A-5C are views taken on lines 5A—5A, 5B—5B, and 5C—5C of FIG. 4, respectively.
Figure 5B:
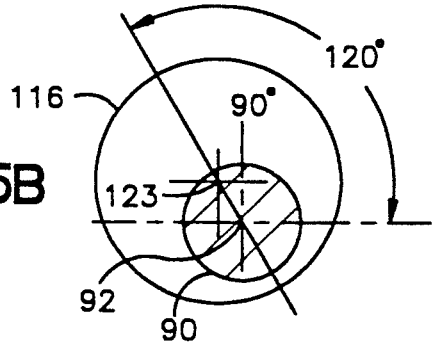
Figure 5C:
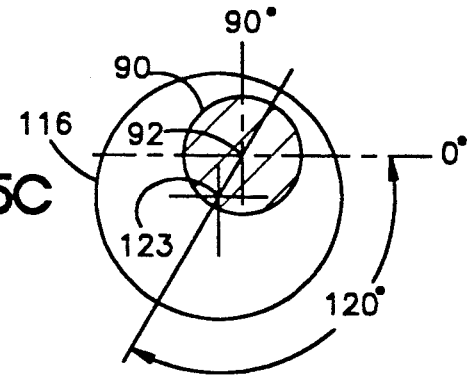
Figure 6:
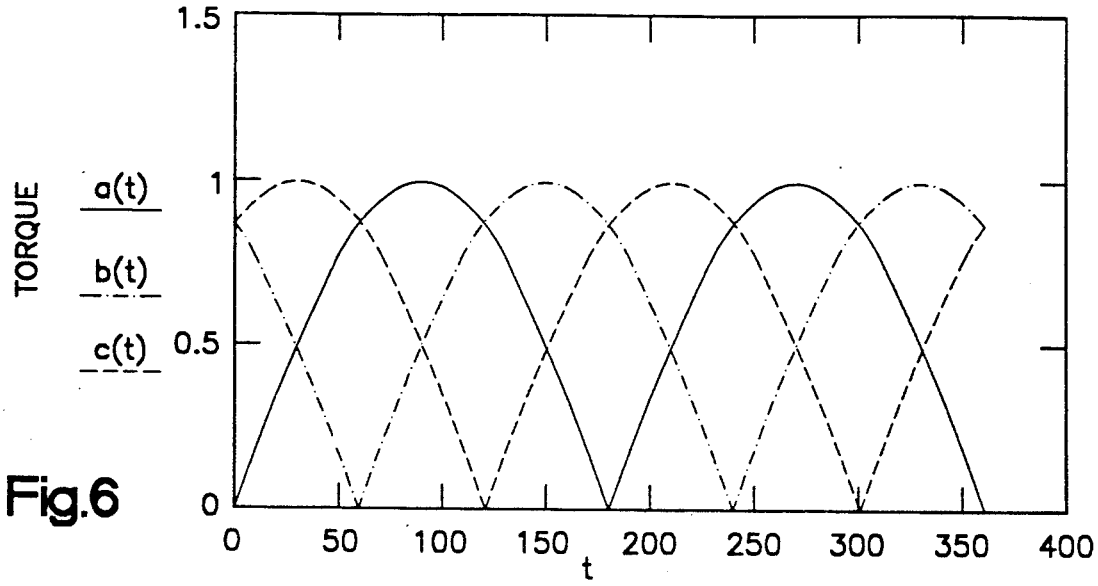
FIGS. 6 and 7 are graphic representations of performance characteristics of the printing unit of FIG. 1.
Figure 7:
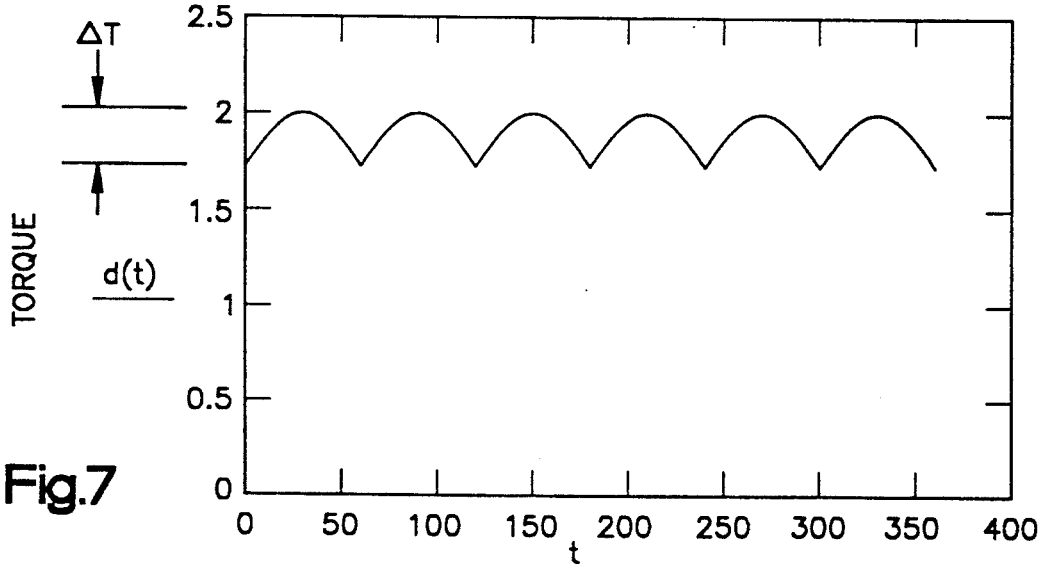

The foregoing principles concerning the torque in the shaft 90 are illustrated graphically in FIGS. 6 and 7. FIG. 6 illustrates the three individual torques applied to the shaft 90 by the three individual eccentric members 116 shown in FIGS. 5A–5C. The level of torque applied to the shaft 90 by each eccentric member 116 is measured on the vertical coordinate axis in FIG. 6. The angular displacement of each eccentric member 116 about the axis 92 of the shaft 90 is measured over time on the horizontal coordinate axis in FIG. 6. The curve a(t) represents the torque attributable to the eccentric member 116 of FIG. 5A, and takes the form of a rectified sine wave as described above. Specifically, the torque represented by the curve a(t) is a function of angular displacement as follows:

$$a(t) = \left|\sin\left(t\frac{\pi}{180}\right)\right|$$

t=0, 1, . . . 360.

The curves b(t) and c(t) similarly represent the torques attributable to the eccentric members 116 of FIGS. 5B and 5(*c*), respectively, as follows:

$$b(t) = \left|\sin\left(t\frac{\pi}{180} + \alpha\right)\right|$$

$$c(t) = \left|\sin\left(t\frac{\pi}{180} + B\right)\right|$$

$$\alpha = 120\frac{\pi}{180}$$

$$B = 240\frac{\pi}{180}$$

Since the three eccentric members 116 of FIGS. 5A, 5B and 5C are offset from each other by 120° about the axis 92 of the shaft 90, the three curves a(t), b(t) and c(t) are offset from each other by 120° along the horizontal coordinate axis of FIG. 6. The three curves a(t), b(t) and c(t) thus reach peak levels (each having a unit value of 1) at times that are evenly spaced from each other throughout one complete revolution of the shaft 90. As a result, the changes in the sum of the individual torques represented by the curves a(t), b(t) and c(t) are minimized as described above. This is illustrated graphically in FIG. 7, in which d(t)=a(t)+b(t)+c(t). The level of the curve d(t) fluctuates over a small range of ΔT. The curve d(t) thus illustrates the relatively steady value of the total torque which is maintained in the shaft 90 during rotation of the shaft 90 in accordance with the present invention.

Figure 8:
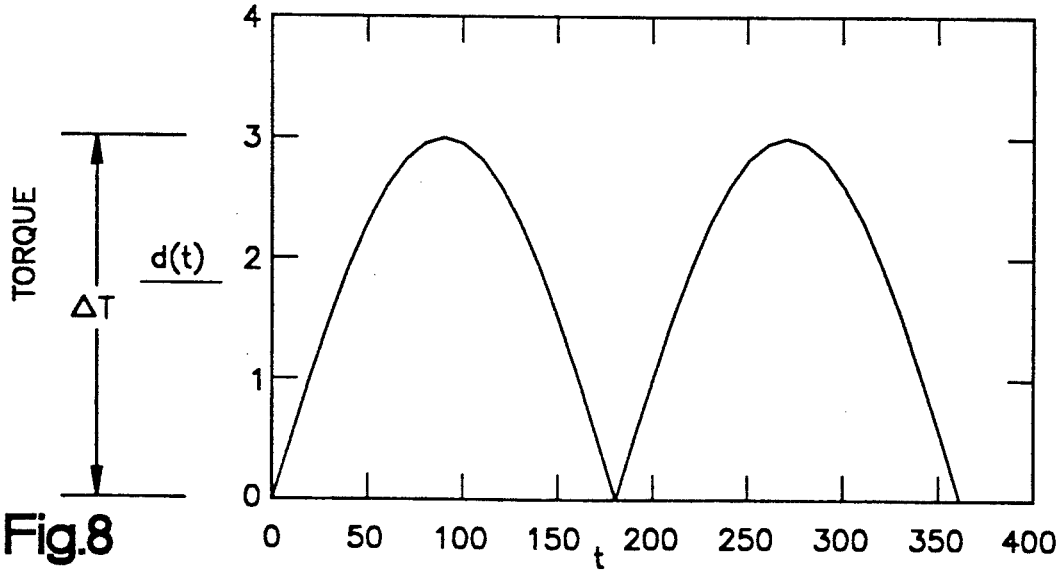
FIG. 8 is a graphic representation of performance characteristics of a hypothetical printing unit for comparison with FIG. 7.

In addition to minimizing the fluctuations in the total torque in the shaft 90, the present invention also minimizes the peak level obtained by the total torque. By way of example, the curve d(t) shown in FIG. 8 represents the total torque that would occur in the shaft 90 if the three eccentric members 116 were not offset from each other about the axis 92. In that case, all three individual torques would reach a peak level having a unit value of 1 at the same time. The total torque at that time would reach a peak level having a unit value of 3, as opposed to the unit value of only 2 for the peak levels of total torque illustrated n FIG. 7. The present invention thus minimizes the peak levels of total torque attained in the shaft 90, as well as the range ΔT over which the level of total torque fluctuates, because the three eccentric members 116 are offset from each other about the axis 92 in optimum amounts.

The present invention has thus far been described with reference to a first preferred embodiment, in which the vibrator mechanism 32 includes three eccentric members 116 mounted on the shaft 90. However, the present invention is also applicable to vibrator mechanisms having different numbers of eccentric members mounted on a shaft. In such cases the centers of any two of the eccentric members would be offset from each other about the axis of the shaft at least by the angle A, as follows:

$$A = \frac{360}{n}$$

n=total number of eccentrics (preferably at least three)

The present invention is further applicable to a printing unit having eccentric members mounted on one or more shafts which are rotated by a common gear train. Such a printing unit is shown schematically in FIG. 9.

Figure 9:
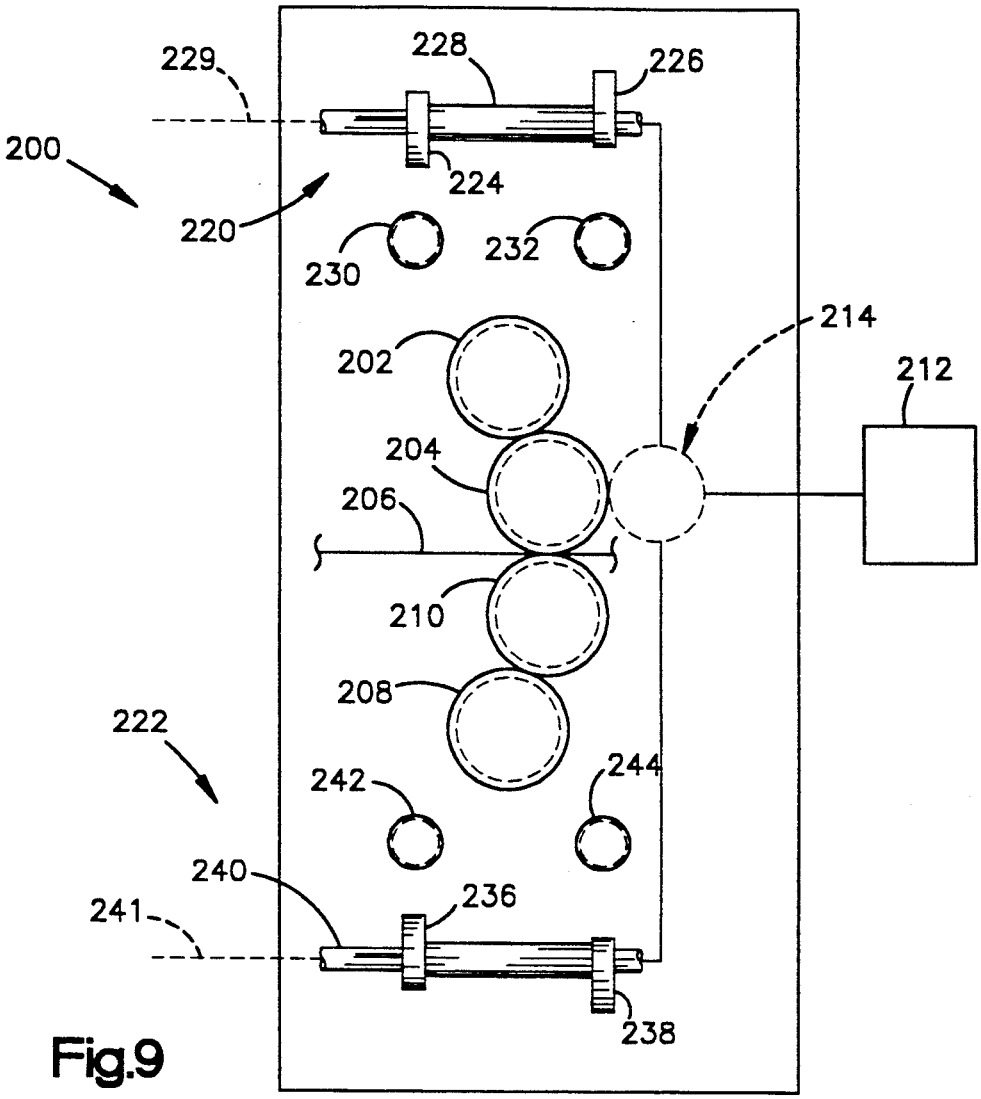
FIG. 9 is a schematic view of a printing unit which comprises a second embodiment of the present invention.

As shown in FIG. 9, a printing unit 200 has an upper plate cylinder 202 and an upper blanket cylinder 204 for transferring an image to the upper side of a web 206, and has a lower plate cylinder 208 and a lower blanket cylinder 210 for transferring an image to the lower side of the web 206. A drive means 212, including a gear train 214, rotates the cylinders 202, 204, 208, and 210. The printing unit 200 also has an upper vibrator mechanism 220 and a lower vibrator mechanism 222.

The upper vibrator mechanism 220 includes a pair of eccentric members 224 and 226 which are mounted on a rotatable shaft 228 having an axis 229. The eccentric members 224 and 226 are connected with a respective pair of ink distributor rolls 230 and 232 to vibrate the ink distributor rolls 230 and 232 axially upon rotation of the shaft 228. The eccentric members 224 and 226 can be connected with the ink distributor rolls 230 and 232 in the manner described above with reference to FIG. 2.

The lower vibrator mechanism 222 also includes a pair of eccentric members 236 and 238. The eccentric members 236 and 238 are mounted on a rotatable shaft 240 having an axis 241. The eccentric members 236 and 238 are similarly connected with a respective pair of ink distributor rolls 242 and 244 to vibrate the ink distributor rolls 242 and 244 axially upon rotation of the shaft 240. The ink distributor rolls 230, 232, 242 and 244 are rotated by the drive means 212 through the gear train 214. The shafts 228 and 240 are simultaneously rotated by the drive means 212 through the gear train 214.

Figure 10:
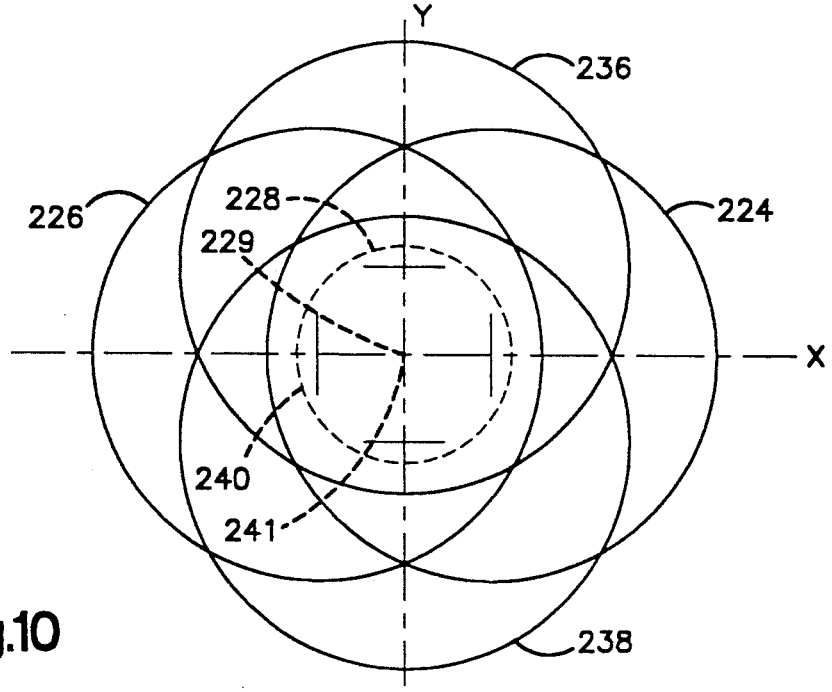
FIG. 10 is a view of parts of the printing unit of FIG. 9.

The eccentric members 224, 226, 236 and 238 on the two shafts 228 and 240 are arranged with reference to each other in accordance with the present invention. Specifically, the two eccentric members 224 and 226 are offset from each other about the axis 229 of the shaft 228 by an angle of 180° in accordance with the formula A=360/n where n=2. The forces exerted back and forth against the adjoining side frame by the two eccentric members 224 and 226 therefore have the maximum tendency to cancel each other, and are thus balanced to minimize the vibration of the side frame which is attributable to the upper vibrator mechanism 220. The other two eccentric members 236 and 238 are likewise offset from each other about the axis 241 of the shaft 240 by an angle of 180°, and have the same minimal tendency to vibrate the adjoining side frame. Moreover, each of the eccentric members 224, 226, 236 and 238 is offset from each other one of the eccentric members 224, 226, 236 and 238 by an angle of at least 90° in accordance with the formula A=360/n where n=4. Since the two pairs of eccentric members are located on the separate shafts 228 and 240, the latter angle A is measured between positions that are superimposed on horizontal and vertical coordinate axes X and Y, as shown in FIG. 10. With the four eccentric members 224, 226, 236 and 238 thus arranged with reference to each other as shown in FIG. 10, the sum of the respective torques transmitted into the gear train 214, as well as the range over which the sum fluctuates, is minimized.

From the above description of the invention, those skilled in the art will perceive improvements, changes and modifications. Such improvements, changes and modifications within the skill of the art are intended to be covered by the appended claims.

Having described the invention, the following is claimed:

1. Apparatus (200) for printing on a web (206), said apparatus (200) comprising:

a first plate cylinder (202) and a first blanket cylinder (204) supported on a frame in positions for said first blanket cylinder (204) to transfer an image from said first plate cylinder (202) to one side of the web (206) upon rotation of said first plate cylinder (202) and said first blanket cylinder (204);

a first ink distributor assembly including a pair of first ink distributor rolls (230, 232) supported on said frame in positions to transfer ink to said first plate cylinder (202) upon rotation of said first ink distributor rolls (230, 232), said first ink distributor rolls (230, 232) being further supported on said frame for reciprocating longitudinal movement;

a second plate cylinder (208) and a second blanket cylinder (210) supported on said frame in positions for said second blanket cylinder (210) to transfer an image from said second plate cylinder (208) to the other side of the web (206) upon rotation of said second plate cylinder (210) and said second blanket cylinder (208);

a second ink distributor assembly including a pair of second ink distributor rolls (242, 244) supported on said frame in positions to transfer ink to said second plate cylinder (208) upon rotation of said second ink distributor rolls (242, 244), said second ink distributor rolls (242, 244) being further supported on said frame for reciprocating longitudinal movement;

gear means for rotating said cylinders (202, 204, 208, 210) and said ink distributor rolls 230, 232, 242, 244) simultaneously, said gear means including a gear train (214) supported on said frame, said gear train (214) being common to said cylinders (202, 204, 208, 210) and said ink distributor rolls (232, 234, 242, 244); and vibrator means for reciprocating said ink distributor rolls (232, 234, 242, 244) upon rotation of said ink distributor rolls (232, 234, 242, 244), said vibrator means including a first vibrator shaft (228) supported on said frame for rotation about a first shaft axis (229), and eccentric members mounted on said first vibrator shaft (228) to rotate with said first vibrator shaft, said eccentric members consisting of a pair of first eccentric members (224, 226), each of said first eccentric members (224, 226) moving a respective one of said first ink distributor rolls (230, 232) axially upon rotation of said first vibrator shaft (228);

said vibrator means further including a second vibrator shaft (240) supported on said frame for rotation about a second shaft axis (241), and eccentric members mounted on said second vibrator shaft (240) to rotate with said second vibrator shaft (240), said eccentric members mounted on said second vibrator shaft (240) consisting of a pair of second eccentric members (242, 244), each of said second eccentric members (242, 244) moving a respective one of said second vibrator rolls (242, 244) axially upon rotation of said second vibrator shaft (240);

each one of said first and second eccentric members (224, 226, 236, 238) being circumferentially offset from each other one of said first and second eccentric members (224, 226, 236, 238) by at least 90°.

2. A printing apparatus as defined in claim 1 wherein said first eccentric members (224, 226) mounted on said first shaft (228) are circumferentially offset from each other by 180°, said second eccentric members (226, 236) mounted on said second shaft (240) also being circumferentially offset from each other by 180°.

* * * * *